US007534173B2

(12) United States Patent
Rees

(10) Patent No.: US 7,534,173 B2
(45) Date of Patent: May 19, 2009

(54) SPREADER PLATE ASSEMBLY FOR COUNTERWEIGHT ARBOR

(75) Inventor: Stephen E. Rees, Dunkirk, NY (US)

(73) Assignee: Research Foundation of State University of New York, Albany, NY (US)

( * ) Notice: Subject to any disclaimer, the term of this patent is extended or adjusted under 35 U.S.C. 154(b) by 397 days.

(21) Appl. No.: 11/372,936

(22) Filed: Mar. 10, 2006

(65) Prior Publication Data

US 2007/0213138 A1 Sep. 13, 2007

Related U.S. Application Data

(60) Provisional application No. 60/660,268, filed on Mar. 10, 2005.

(51) Int. Cl.
*A63J 1/02* (2006.01)

(52) U.S. Cl. ..... 472/78; 472/79

(58) Field of Classification Search ..... 472/75–80; 482/93–94, 98–103; 16/96 D, 93 D; 254/270, 254/271, 334, 336
See application file for complete search history.

(56) References Cited

U.S. PATENT DOCUMENTS

| | | | | |
|---|---|---|---|---|
| 1,422,888 | A * | 7/1922 | Reeves et al. | 482/93 |
| 3,165,296 | A | 1/1965 | Drew | |
| 4,134,177 | A | 1/1979 | Janson | |
| 4,303,237 | A | 12/1981 | Hoffend, Jr. et al. | |
| 5,106,057 | A | 4/1992 | Feller et al. | |
| 5,531,297 | A | 7/1996 | Pipan | |
| 5,711,713 | A | 1/1998 | Krueger | |
| 5,911,410 | A * | 6/1999 | Wullimann | 254/334 |
| 6,126,579 | A * | 10/2000 | Lin | 482/98 |
| 6,520,485 | B1 | 2/2003 | Soot | |
| 6,537,155 | B2 | 3/2003 | Steve et al. | |
| 6,855,063 | B2 | 2/2005 | Murphy et al. | |
| 2005/0075221 | A1 * | 4/2005 | Fond | 482/93 |

* cited by examiner

*Primary Examiner*—Kien Nguyen
(74) *Attorney, Agent, or Firm*—Woods Oviatt Gilman LLP

(57) ABSTRACT

A spreader plate assembly intended for use with an arbor carriage includes two congruent rectangular plates, one overlying the other. Each plate has two spaced apart notches disposed on one long side and a circular bore near one of the short sides. The plates are connected in mirror-reversed position relative to one another by a fastener inserted through the bore in each plates, thereby pivotably connecting them and enabling them to be moved relative to one another between an open and a closed position. In the closed position, the two spaced apart notches of each plate straddle two spaced apart vertical rods of the arbor carriage.

10 Claims, 2 Drawing Sheets

SPREADER PLATE ASSEMBLY FOR COUNTERWEIGHT ARBOR

CROSS-REFERENCE TO RELATED APPLICATION

The applicant claims the priority benefit of Provisional Application Ser. No. 60/660,268, filed Mar. 10, 2005, the disclosure of which is incorporated herein by reference.

FIELD OF THE INVENTION

The present invention relates to apparatus for moving theatrical stage equipment, particularly counterweight arbor apparatus for raising and lowering the equipment and, more particularly, a spreader plate assembly for use with the arbor apparatus.

BACKGROUND OF THE INVENTION

Theatrical stage equipment includes devices that are required to be raised and lowered prior to and during a performance to provide a desired scene effect. These devices include various rigging sets, for example, curtains, borders, screens, scene displays, and lighting fixtures. The rigging sets, which are generally coextensive in length with a proscenium opening of the theatre have substantial weight.

A counterweight rigging commonly used in the theater industry to lift objects overhead on a stage or other location typically comprises a head block, a counterweight arbor, a floor block, loft blocks, a batten, lift lines, a rope handline, and a rope lock. The batten, which typically comprises a pipe or rod, is supported along its length by a plurality of flexible ropes or wires, each associated with a pulley. An item that is to be lifted is attached to the batten on stage, and an equal amount of counterweight in the form of metal plates is added to the counterweight arbor carriage. In this balanced condition, the counterweight arbor can be moved with a minimum of effort by pulling on the handline. Depending on the weight to be lifted, the total amount of counterweight on the arbor carriage can be adjusted by adding or removing an appropriate number of counterweight plates.

Movement of the counterweight arbor can be accomplished either by manually pulling the handline, or by driving the head block with an electric motor. Various counterweight arbor devices are described in, for example, U.S. Pat. Nos. 3,165,296; 4,134,177; 4,303,237; 5,106,057; 5,531,297; 5,711,713; 6,520,485; 6,537,155; and 6,855,063, the disclosures of which are incorporated herein by reference.

In recent years, manufacturers of counterweight systems have provided counterweight arbors with a sufficient number of spreader plates to allow their interspersing at two-foot intervals in the stack of counterweight plates on the arbor carriage. In the event of an unbalanced or "runaway" arbor, this placement of spreader plates serves to control the forces exerted on the vertical rods of the arbor carriage and prevent the counterweight plates from spilling off the arbor carriage.

Addition of spreader plates to older installed counterweight systems to improve their safety is desirable but would require an expensive and time-consuming dismantling of the arbor apparatus. It would be highly desirable to be able to install additional spreader plates on the arbor apparatus without dismantling it. The present invention provides the benefit of convenient and economical addition of spreader plates to an arbor carriage.

SUMMARY OF THE INVENTION

The present invention is directed to a spreader plate assembly intended for use with an arbor carriage having a spaced apart top member and bottom member connected by two substantially vertical rods, and adapted to hold rectangular counterweight plates whose two short sides are each provided with a slot that straddles one of the vertical rods.

The spreader plate assembly comprises a substantially rectangular first plate and a substantially rectangular second plate overlying the first plate. Each of the plates comprises two spaced apart notches disposed on the first of the two long sides and a first circular bore proximate the first of the two short sides. The second plate is congruent with but disposed in mirror-reversed position relative to the first plate.

A first elongate fastener of circular cross-section dimensioned to fit within the first bores in the plates is inserted through the first bore in each of the plates, thereby pivotably connecting them and enabling them to be moved relative to one another between an open position and a superimposed closed position. In the closed position, the two spaced apart notches in each first long side of the first and second plates straddle the two spaced apart substantially vertical rods of the arbor carriage.

DETAILED DESCRIPTION OF THE INVENTION

Figure 1:
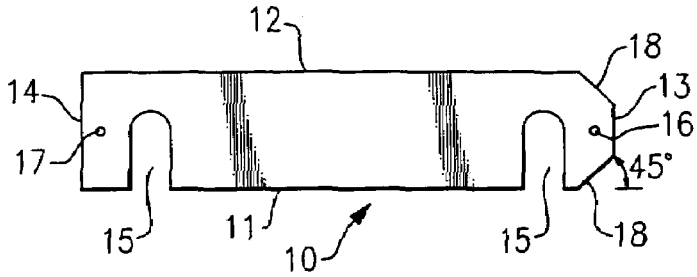
FIGS. 1 and 2 are, respectively, top and side plan views of a plate of the spreader plate assembly.

FIG. 1 depicts one of two congruent substantially rectangular plates 10 that comprise the spreader plate assembly 30 (cf. FIG. 3) of the present invention. Each plate 10 has long sides 11 and 12 and short sides 13 and 14. First long side 11 includes two spaced apart notches 15. A first circular bore 16 is located near first short side 13, and a second circular bore 17 is located near second short side 14. Long sides 11 and 12 are tapered at first short side 13, the taper 18 preferably having an angle of about 45 degrees relative to side 13.

Plates 10 are preferably formed from steel, more preferably, 16 gauge steel. Notches 15 and tapers 18 can be formed by laser cutting.

Figure 2:
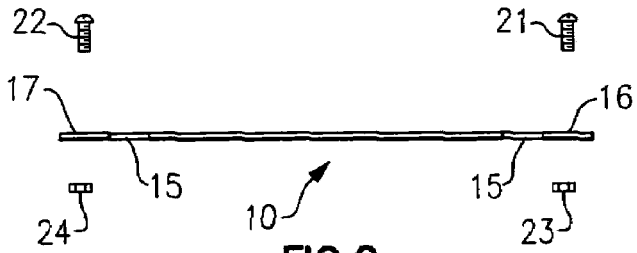

FIG. 2 is a side view of plate 10, showing notches 15 and bores 16 and 17. Also depicted in FIG. 2 are threaded bolts 21 and 22, which are inserted through bores 16 and 17, respectively, and are secured by nuts 23 and 24, respectively. Bolts 21 and 22 and nuts 23 and 24 are preferably formed from stainless steel.

Figure 3A:
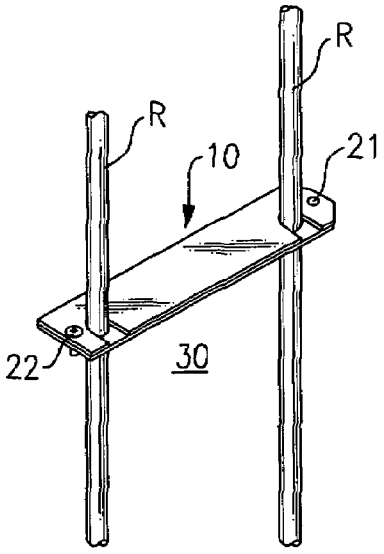
FIGS. 3A and 3B are isometric views depicting the vertical rods of the arbor carriage and the plates of the spreader plate assembly in their closed and open positions.
Figure 3B:
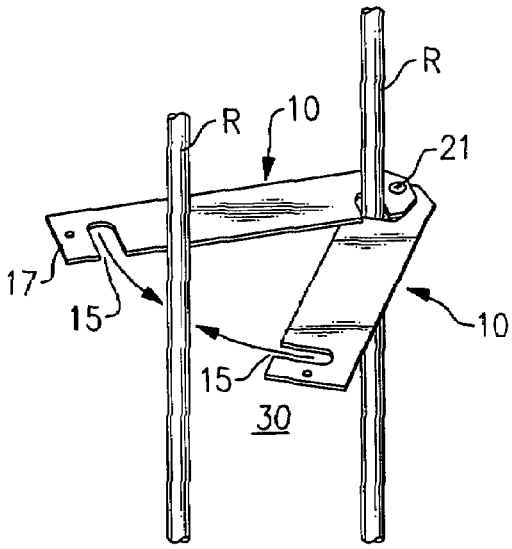

FIGS. 3A and 3B are isometric views of arbor carriage rods R and spreader plate assembly 30 of the present invention, showing plates 10 in both the closed and open positions. Congruent plates 10 are secured in a mirror-reversed position relative to one another by bolt 21 and nut 23 (not shown). When spreader plate assembly is in its closed position, the spaced apart notches 15 of both plates 10 straddle the spaced apart arbor carriage rods R, and plates 10 are held together by subsequently inserted bolt 22, which is secured by nut 24 (not shown).

Figure 4:
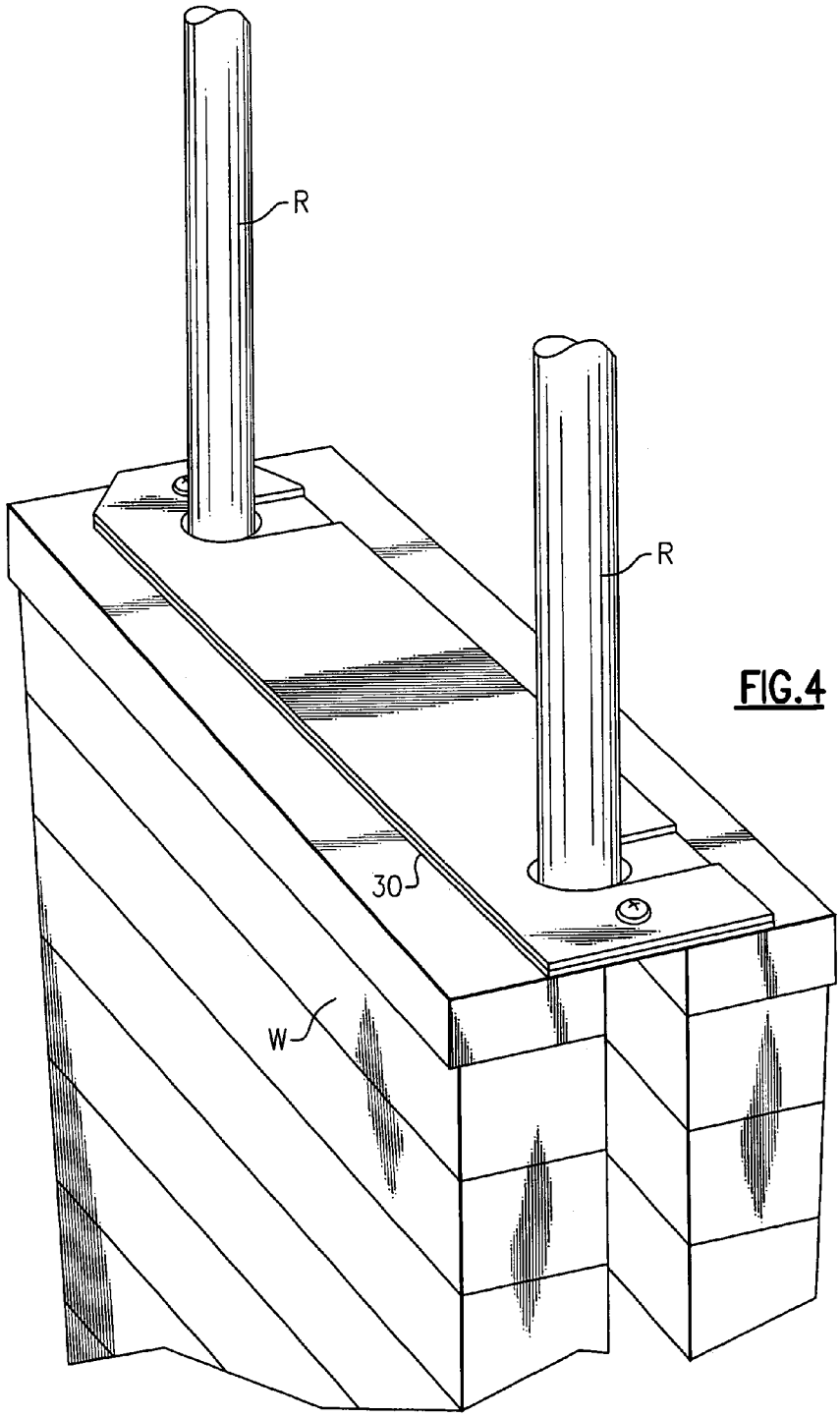
FIG. 4 is an isometric view depicting the installation of the spreader plate assembly on a stack of counterweight plates on the arbor carriage.

FIG. 4 is an illustration depicting the installation of the spreader plate assembly 30 on a stack of counterweight plates W on rods R of the arbor carriage. Should a mishap resulting from an unbalanced arbor occur, spreader plate assembly 30 can help prevent the spilling of counterweight plates W from the arbor carriage. The spreader plate assembly can serve the further function of providing a line of demarcation between the constant weight of the batten and the load weight on the arbor. Painted a distinctive color, red for example, it can alert a stagehand when to cease removing counterweight plates from the arbor carriage.

The invention has been described in detail with particular reference to certain preferred embodiments thereof, but it is understood that variations and modifications can be effected within the spirit and scope of the invention, which is defined by the claims that follow.

What is claimed is:

1. A spreader plate assembly for use with an arbor carriage having a spaced apart top member and bottom member connected by two substantially vertical rods and adapted to hold rectangular counterweight plates having two short sides each provided with a slot that straddles one of said vertical rods, said spreader plate assembly comprising:

a substantially rectangular first plate and a substantially rectangular second plate overlying said first plate, each said first and second plates comprising two spaced apart notches disposed on the first of the two long sides and a first circular bore proximate the first of the two short sides, said second plate being congruent with but disposed in mirror-reversed position relative to said first plate; and a first elongate fastener of circular cross-section dimensioned to fit within said first circular bores in said plates, said fastener being inserted through said first circular bore in each of said plates, thereby pivotably connecting said plates and enabling said plates to be moved relative to one another between an open position and a superimposed closed position;

wherein, in said closed position, said two spaced apart notches in said first long side of each of said first and second plates adapted to straddle said two spaced apart substantially vertical rods of said arbor carriage.

2. The spreader plate assembly of claim 1 wherein said first and second plates each further comprise a second circular bore proximate the second of said two short sides, and said spreader plate assembly further comprises a second elongate fastener of circular cross-section dimensioned to fit within said second circular bore in each of said plates, said fastener being inserted through said second circular bores in said plates when said plates are in said superimposed closed position.

3. The spreader plate assembly of claim 2 wherein each of said first and second elongate fasteners is a threaded bolt.

4. The spreader plate assembly of claim 3 wherein each said threaded bolt is secured to said spreader plate assembly by a nut.

5. The spreader plate assembly of claim 4 wherein said threaded bolts and said nuts are formed from stainless steel.

6. The spreader plate assembly of claim 1 wherein said first elongate fastener is a rivet or a threaded bolt fitted with a nut.

7. The spreader plate assembly of claim 1 wherein each of said two long sides of each said plate are tapered proximate said first short side of each said plate.

8. The spreader plate assembly of claim 7 wherein said each of said two long sides of each said plate are tapered at an angle of about 45 degrees relative to said short side.

9. The spreader plate assembly of claim 1 wherein said first plate and said second plate are each formed from steel.

10. A spreader plate assembly for use with an arbor carriage having a spaced apart top member and bottom member connected by two substantially vertical rods and adapted to hold rectangular counterweight plates having two short sides each provided with a slot that straddles one of said vertical rods, said spreader plate assembly comprising:

a substantially elongate rectangular first plate and a elongate substantially rectangular second plate overlying said first plate, each said first and second plates comprising two spaced apart notches disposed on the first of the two long sides and a first bore proximate the first of the two short sides, said second plate being congruent with but disposed in mirror-reversed position relative to said first plate; and a first elongate fastener of cross-section dimensioned to fit within said first bores in said plates, said fastener being inserted through said first circular bore in each of said plates, thereby pivotably connecting said plates and enabling said plates to be moved relative to one another between an open position and a superimposed closed position;

wherein, in said closed position, said two spaced apart notches in said first long side of each of said first and second plates adapted to straddle said two spaced apart substantially vertical rods of said arbor carriage.

* * * * *